United States Patent [19]

Schreib

[11] 3,999,367

[45] Dec. 28, 1976

[54] CABLE DRIVE MOVEMENT FOR CLOCKS

[75] Inventor: Karl Schreib, Schwenningen, Germany

[73] Assignee: Erhard Jauch, Uhrenfabrik, Schwenningen, Germany

[22] Filed: Sept. 19, 1974

[21] Appl. No.: 507,487

[30] Foreign Application Priority Data

Sept. 20, 1973 Germany ..... 2347368

[52] U.S. Cl. ..... 58/2 R; 58/46 R; 242/76; 254/190 R

[51] Int. Cl.[2] ..... G04B 1/02; B65H 77/00; B66D 1/36

[58] Field of Search ..... 58/2, 46 R, 46 W, 58/48; 242/76; 254/135, 190, 197

[56] References Cited

UNITED STATES PATENTS

| | | | |
|---|---|---|---|
| 214,362 | 4/1879 | Camichel | 58/46 R |
| 848,905 | 4/1907 | Jenson | 254/188 |
| 2,659,267 | 11/1953 | Baule | 242/76 |
| 2,760,735 | 8/1956 | Allen | 242/76 |
| R3,606 | 8/1869 | Mayer | 58/46 R |

FOREIGN PATENTS OR APPLICATIONS

| | | | |
|---|---|---|---|
| 23,802 | 1/1903 | Germany | 58/46 R |
| 96,315 | 4/1898 | Germany | 58/46 R |

OTHER PUBLICATIONS

Milham, Willis I., Time and Timekeepers, 11–1923 pp. 74–76.

*Primary Examiner*—E. S. Jackmon

[57] ABSTRACT

A cable drive movement for driving clocks in which a cable roller is mounted rotatably on a movement plate with a cable being slung around the roller, the cable being subjected to the pull of a weight and having one end fastened on the cable roller and another end fastened to the movement plate. A cable securing device is provided for holding the cable on the roller. This device may take the form of a clip which encircles a part of the periphery of the roller. The holding device may also take the form of a spring which includes a lower end joined to the movement plate and an upper end engaging the cable beneath the cable roller.

4 Claims, 2 Drawing Figures

CABLE DRIVE MOVEMENT FOR CLOCKS

FIELD OF THE INVENTION

This invention relates to cable movements for driving clocks and more particularly to cable movements of the type in which a cable roller mounted rotatably on a movement plate carries a cable slung around it and acted on by the pull of a weight, one end of the cable being fastened to the cable roller and the other end to the movement plate.

BACKGROUND

In known cable drive movements for clocks, the cable frequently jumps out of the associated grooves provided therefor in the associated cable roller when the clock is wound or during transport. The weight applying tension to the cable consequently drops and may cause damage. Furthermore, the cable has to be painstakingly rewound a number of times around the cable roller and introduced into the grooves on the periphery of the latter.

SUMMARY OF THE INVENTION

It is an object of the invention to provide for preventing the cable from jumping out of the grooves in a cable roller and to prevent the above-noted undesirable consequences.

According to the invention, the above and other objects are achieved with the aid of a cable securing means which consists of a holding device holding the cable on the cable roller.

In a preferred embodiment, the holding device includes a clip lying against the upper part of the periphery of the cable roller and fastened on a pin on an associated movement plate. This form of construction is very simple to employ and provides the advantage that it can remain in position even during the operation of the cable drive movement without hindering the rotation of the cable roller and the movement of the cable.

Another advantageous form of construction of the holding device is suitable only as transport securing means and consists of a spring which is disposed roughly vertically and is connected at its lower end to the movement plate and at its upper end to the cable underneath the cable roller.

It is preferred for this spring always to be secured by one end to the movement plate, hanging therefrom, and, when transport is intended, to be attached to an element provided for the purpose on the cable. In the attached condition, the spring is under tension and transmits this tension to the portion of the cable which runs around the cable roller. Consequently, the latter cannot jump out of the grooves in the roller.

BRIEF DESCRIPTION OF ACCOMPANYING DRAWING

DETAILED DESCRIPTION OF DRAWING

Figure 1:
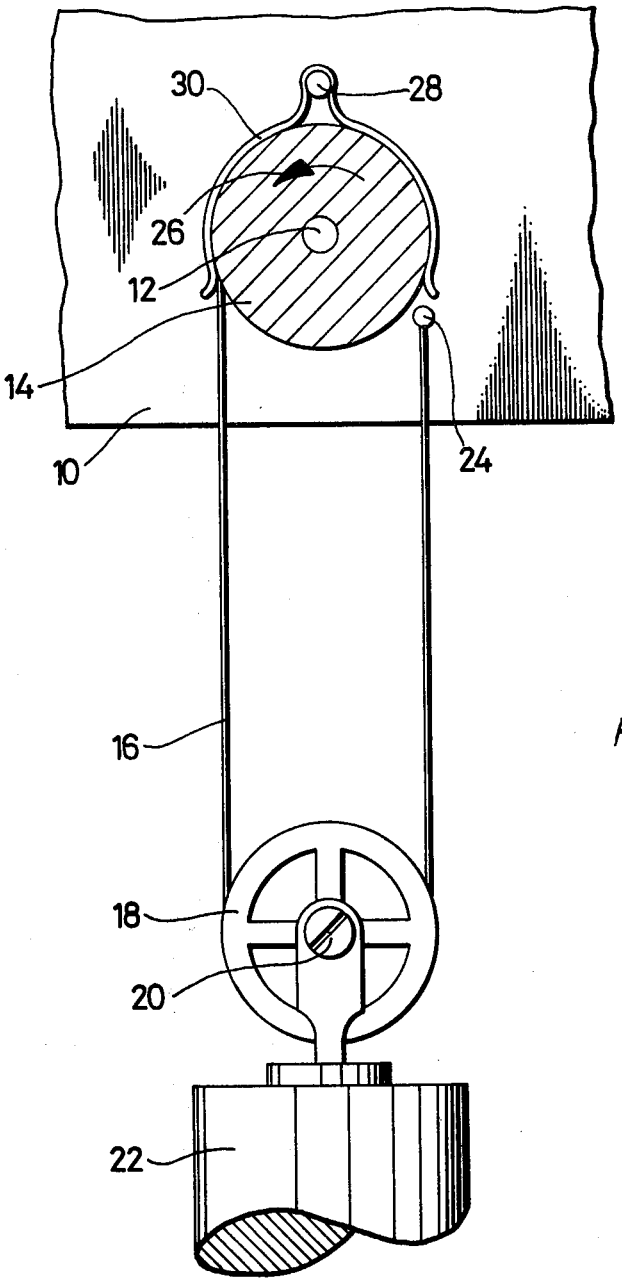
FIG. 1 is a side view of a preferred construction of the cable drive movement for a clock in accordance with the present invention.

In the drawing, a generally horizontal cable roller 14 provided on its periphery with grooves (not shown) is mounted rotatably on a movement plate 10 by means of a shaft 12. The cable 16 which is inserted into the grooves, and which is usually wound a number of times around the cable roller, extends vertically downwards from one side of the cable roller and is guided around a return and weight roller 18. A weight 22 freely pivotable about a horizontal axle 20 of roller 18 is suspended from this roller.

The cable 16 runs vertically upwards on leaving the return roller 18 and, at its upper-end, is fastened to a holding element 24 mounted on the movement plate 10. Under the action of the weight 22, the cable roller 14 turns in the direction of the arrow 26.

According to the invention, a clamp or clip 30 is fastened on a pin 28 mounted on the movement plate 10 above the roller 14, the two arms of the clip bearing against the upper portion and preferably more than one-half of the periphery of the cable roller. The arms thus prevent the cable from jumping out of the grooves in the periphery of the cable roller during the winding or transport of the clock. However, at the same time, the arms permit practically unhindered operation of the cable drive movement, since the sliding friction between the periphery of the cable roller and the cable, on the one hand, and the arms of the clip 30, on the other hand, is so slight that no marked impairment of the drive is caused.

The clip can, for example, be manufactured of spring steel, phosphor bronze, berrylium copper or the like and, under certain circumstances, may be of natural or synthetic rubber or plastic materials. The clip can also be monolithic or fabricated of two or more parts connected by a spring or springs.

Figure 2:
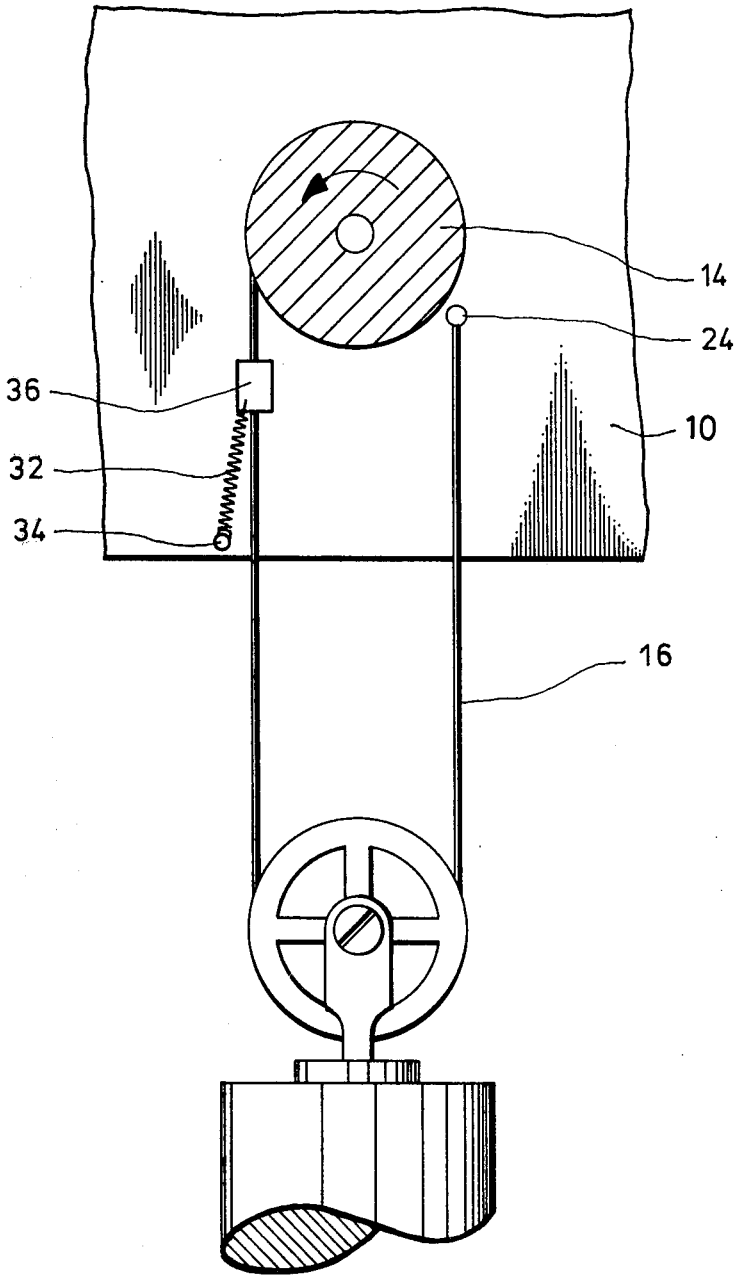
FIG. 2 is a side view similar to FIG. 1 showing a modification of the present invention.

FIG. 2 illustrates a modification designed for transport purposes. In this embodiment, one end of a spring 32 is secured to a pin 34 of the movement plate 10. The cable 16 is provided with a detachable clip 36, to which the free end of the spring 32 is connected under tension sufficient to hold the cable in the grooves of the cable roller 14.

During transport the spring 32 and clip 36 are positioned as shown in FIG. 2 to keep the cable 16 taunt and prevent the cable from moving out of the grooves in the cable roller 14. When the clock reaches its destination and is being set for normal operation, the spring 32 and clip 36 are removed leaving the cable 16 free to function normally under the influence of the weight 22.

There will now be obvious to those skilled in the art, many modifications and variations of the above arrangements. Such modifications and variations will not depart from the scope of the invention if defined by the following claims.

What is claimed is:

1. A cable securing means for a cable drive movement for driving clocks, said movement comprising a movement plate, a weight, a first cable roller mounted generally horizontally and rotatably on said movement plate, a cable slung around said roller and subjected to the pull of said weight, and a second cable roller coupling said weight to said cable, said cable having one end fastened on the first cable roller and another end fastened to the movement plate, said cable securing means including a holding device holding the cable on the first cable roller while said weight is coupled to said roller, said holding device including a pin mounted on the movement plate above said cable roller, and a clip fastened on said pin and lying against a substantial portion of the upper portion of the periphery of the cable roller.

2. A cable securing means as claimed in claim 1 wherein said clip is a curved member with a curved surface resiliently bearing against said upper portion of the periphery of the cable roller.

3. A cable securing means for a cable drive movement for driving clocks, said movement comprising a movement plate, a weight, a first cable roller mounted generally horizontally and rotatably on said movement plate, a cable slung around said roller and subjected to the pull of said weight, and a second cable roller coupling said weight to said cable, said cable having one end fastened on the first cable roller and another end fastened to the movement plate, said cable securing means including a holding device holding the cable on the first cable roller while said weight is coupled to said roller, said holding device including a spring disposed generally vertically and having a lower end secured to the movement plate and an upper end engaging the cable on the side thereof extending from the first cable roller, a second pin secured to said movement plate and supporting said lower end of the spring, and a removable holding clip carried on the cable and connected to the upper end of the spring.

4. A cable drive movement as claimed in claim 1, wherein said clip engages more than one-half the periphery of said roller.

* * * * *